US012514354B1

(12) United States Patent
Chen et al.

(10) Patent No.: US 12,514,354 B1
(45) Date of Patent: Jan. 6, 2026

(54) ARTIFICIAL NAIL WITH ANTI-OVERFLOW STRUCTURE

(71) Applicant: Guangzhou Bodhi Information Technology Co., Ltd., Guangzhou (CN)

(72) Inventors: Yiping Chen, Guangzhou (CN); Xingwang Chen, Guangzhou (CN)

(73) Assignee: GUANGZHOU BODHI INFORMATION TECHNOLOGY CO., LTD., Guangzhou (CN)

( * ) Notice: Subject to any disclaimer, the term of this patent is extended or adjusted under 35 U.S.C. 154(b) by 0 days.

(21) Appl. No.: 19/218,573

(22) Filed: May 26, 2025

(30) Foreign Application Priority Data

Apr. 2, 2025 (CN) ..... 202510411858.5

(51) Int. Cl.
*A45D 31/00* (2006.01)

(52) U.S. Cl.
CPC ..... *A45D 31/00* (2013.01)

(58) Field of Classification Search
CPC ..... A45D 31/00; A45D 2031/005
See application file for complete search history.

(56) References Cited

U.S. PATENT DOCUMENTS

2008/0017214 A1* 1/2008 Han ..... B29C 45/16 132/73
2014/0123993 A1* 5/2014 Chang ..... A45D 31/00 132/73
2014/0130820 A1* 5/2014 Chang ..... A45D 31/00 132/73
2025/0017351 A1* 1/2025 Lotti ..... A45D 31/00

* cited by examiner

*Primary Examiner* — Tatiana L Nobrega
(74) *Attorney, Agent, or Firm* — Frank Niranjan

(57) ABSTRACT

An artificial nail includes an artificial nail body which is convex upwardly. The artificial nail body has an upper surface and a lower surface opposite to the upper surface. The artificial nail body further comprises a blocking surface which extends downwardly from a rear edge of the lower surface and is located between the lower surface and the upper surface. During the adhesive application and pressing process, any adhesive that tends to overflow outward is initially blocked by the blocking surface. For the adhesive to leak, it must overcome the barrier of the blocking surface. Thus, the adhesive is unlikely to overflow from the lower surface, thus preventing any impact on the nail's aesthetic appearance.

8 Claims, 5 Drawing Sheets

ARTIFICIAL NAIL WITH ANTI-OVERFLOW STRUCTURE

FIELD

The present invention belongs to the technical field of beautifying nails, in particular to an artificial nail including an anti-overflow structure to prevent the flow of adhesive from the lower surface of the artificial nail.

BACKGROUND

Artificial nails come in a variety of styles and can be attached to the surface of natural nails to improve the aesthetic appearance of the natural nails and protect the natural nails. One type of artificial nail comprises a curved body that corresponds to a natural nail in the shape. The artificial artificial nail body has an upper side (upper surface) and a lower side (lower surface), and a peripheral edge surface connecting the edges of the front and lower surfaces.

In operation, the user applies adhesive (such as UV glue) to the lower surface of the artificial artificial nail body. The adhesive-coated lower surface is then aligned and pressed firmly onto the natural nail. While maintaining pressure on the artificial artificial nail body, UV light is irradiated onto the upper surface of the artificial artificial nail body and penetrate the artificial artificial nail body to cure the UV adhesive applied on the lower surface of the artificial nail, thereby securely bonding the artificial nail to the natural nail.

During operation, it is necessary to apply an adequate amount of adhesive on the lower surface of the artificial artificial nail body, typically covering the rear half of the lower surface (depending on the artificial nail design), to ensure a strong bond formed between the artificial artificial nail body and the natural nail once the adhesive is cured. However, since the adhesive is in a fluid state (usually quite viscous) before curing, excess adhesive can easily flow out from the edges of the lower surface onto the peripheral edge surface during the coating or pressing process. In some severe cases, the adhesive may even overflow onto the upper surface of the artificial artificial nail body, which influences the nail beautifying effect.

SUMMARY

It is desired is to provide an artificial nail including an anti-overflow structure to prevent the flow of adhesive from the lower surface of the artificial nail.

An artificial nail comprises an artificial nail body which is convex upwardly. The artificial nail body has an upper surface and a lower surface opposite to the upper surface. The artificial nail body further comprises a blocking surface which is bent from an edge of the lower surface in a direction away from the upper surface and is located between the lower surface and the upper surface.

Preferably, the artificial nail body further comprises a peripheral edge surface located between peripheral edges of the upper surface and the lower surface, and the blocking surface is located between the lower surface and the peripheral edge surface.

Preferably, the blocking surface is arranged between the rear edge of the lower surface and the peripheral edge surface.

Preferably, a sharp corner is formed between the blocking surface and the peripheral edge surface.

Preferably, a transition surface extends downwardly from an edge of the upper surface and is located between the peripheral edge surface and the edge of the upper surface.

Preferably, the transition surface is located between the peripheral edge surface and a rear edge of the upper surface.

Preferably, the transition surface is a convexly curved surface and the blocking surface is a concavely curved surface.

Preferably, a first sharp corner is formed between the transition surface and the peripheral edge surface, and the first sharp corner has a first included angle of less than 90°; a second sharp corner is formed between the blocking surface and the peripheral edge surface and the second sharp corner has a second included angle of less than 90°; and the first included angle is greater than the second included angle.

Preferably, the transition surface comprises a front edge joining the lower surface and a rear edge joining a side of the peripheral edge surface; and the blocking surface comprises a front edge joining the upper surface and a rear edge joining an opposite side of the peripheral edge surface.

Preferably, corresponding points of the front edges of the transition surface and the blocking surface have same radius of curvature.

Preferably, corresponding points of the rear edges of the transition surface and the blocking surface have same radius of curvature.

In the present invention, the artificial nail has a blocking surface disposed between the lower surface and upper surface of the artificial nail body. In operation, the user first applies an adequate amount of adhesive in the form of a viscous fluid to the adhesive-coating area on the lower surface of the artificial nail body. The adhesive-coated lower surface is then aligned and pressed firmly onto the natural nail. During the adhesive application and pressing process, any adhesive that tends to overflow outward is initially blocked by the blocking surface. Compared to the prior arts, the adhesive is unlikely to overflow from the lower surface, thus preventing any impact on the nail's aesthetic appearance.

REFERENCE NUMERALS

1: artificial nail body; 11: upper surface; 12: lower surface; 13: peripheral edge surface; 14: blocking surface; 141: front edge of blocking surface; 142: rear edge of blocking surface; 15: transition surface; 151: front edge of transition surface; 152: rear edge of transition surface

DESCRIPTION OF THE EMBODIMENTS

The invention will be described in further detail below in conjunction with specific embodiments.

Figure 1:
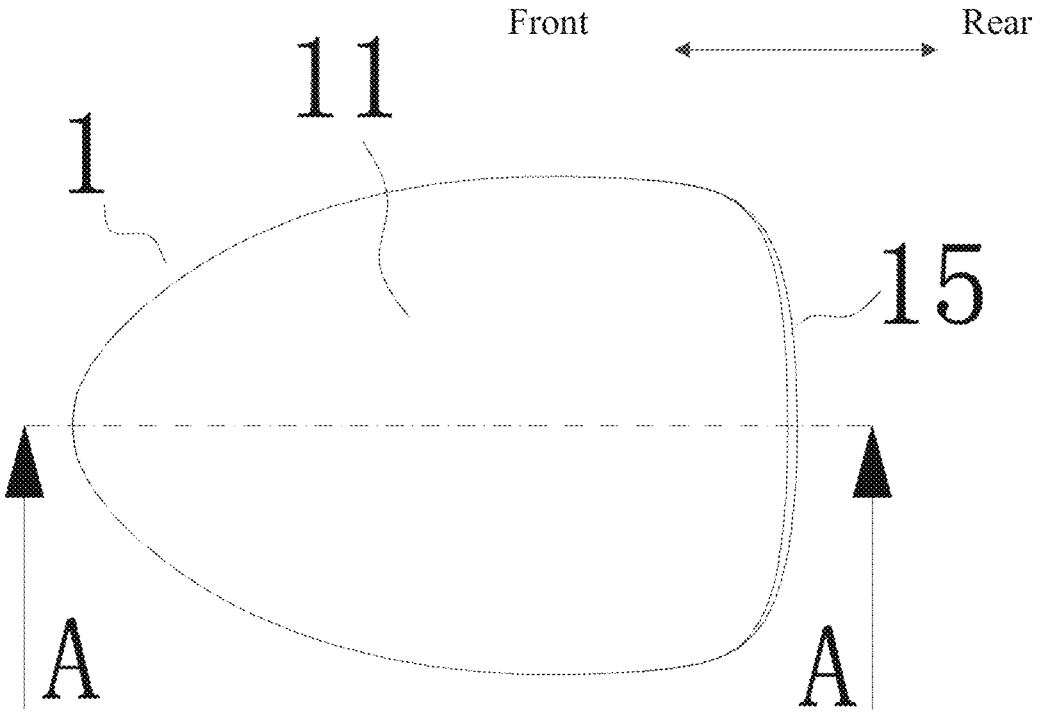
FIG. 1 is a schematic top view of an artificial nail with an anti-overflow structure.
Figure 2:
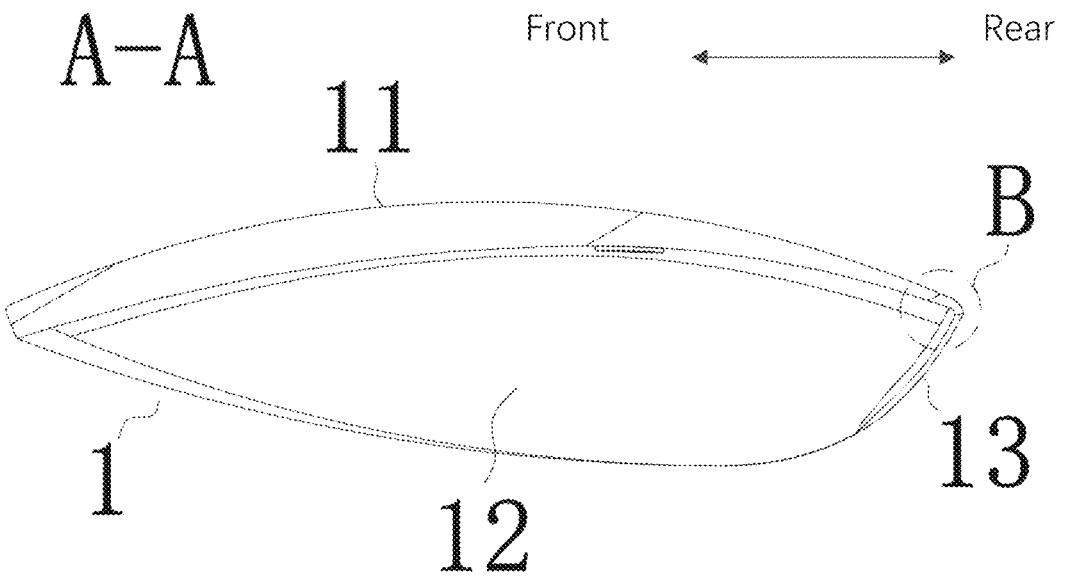
FIG. 2 is a cross-sectional schematic view taken along line A-A in FIG. 1.

Referring to FIGS. 1 and 2, the artificial nail in accordance with an embodiment of the present invention includes an upwardly arched artificial nail body 1 which resembles a natural nail in the shape. The artificial nail body 1 has a convex upper surface 11 configured to face away from a surface of a natural nail, a concave lower surface 12 configured to face the surface of the natural nail and a peripheral edge surface 13 located between the edges of the upper surface 11 and the lower surface 12.

Figure 3:
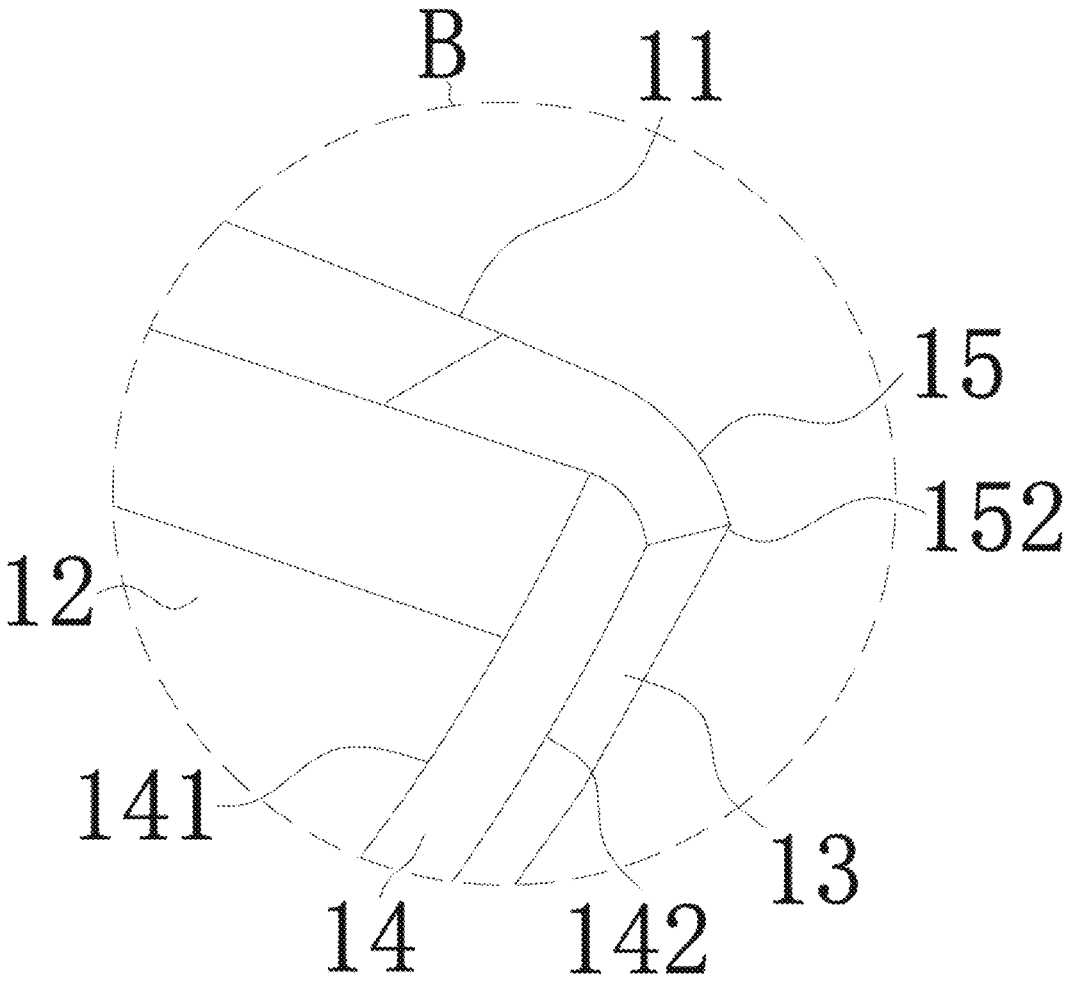
FIG. 3 is an enlarged view of portion B in FIG. 2.
Figure 4:
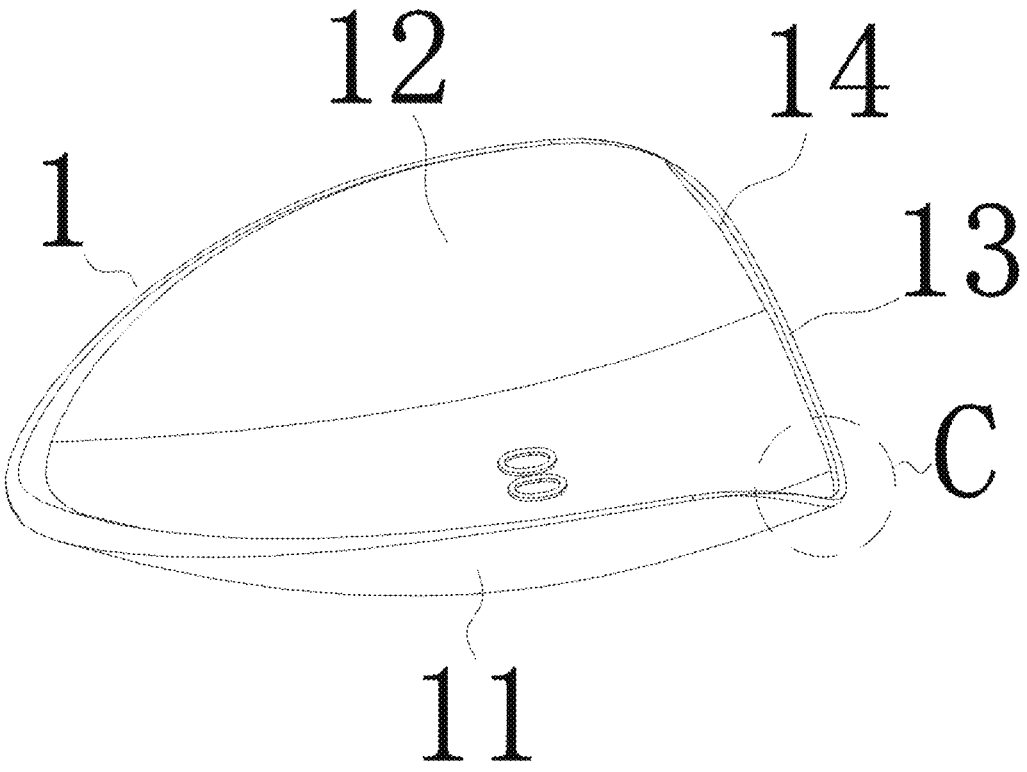
FIG. 4 is a schematic structural view of the artificial nail with its lower surface facing upward.
Figure 5:
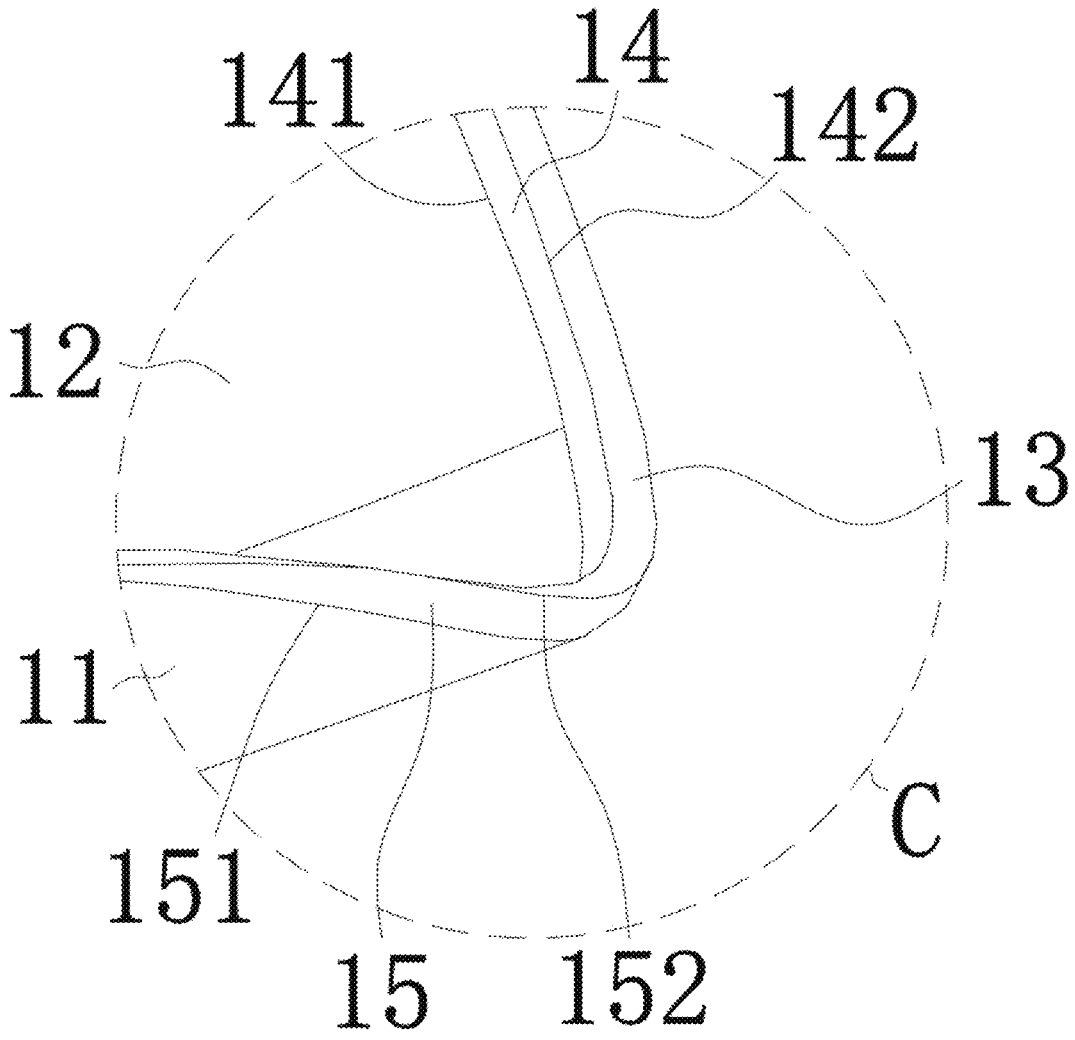
FIG. 5 is an enlarged view of portion C in FIG. 4.

As illustrated in FIGS. 3 and 4, a blocking surface 14 is formed at the rear edge of the lower surface 12 of the artificial nail body 1. The blocking surface 14 may be bent from the rear edge or other positions of the lower surface 12 in a direction away from the upper surface 11 smoothly or non-smoothly/sharply. More specifically, the blocking surface 14 extends downwardly and rearwardly from the rear edge of the lower surface 12 to form a flange protruding from the lower surface 12. The blocking surface 14 is formed between the lower surface 12 and the edge surface 13. Additionally, as shown in FIGS. 1, 2, and 3, a transition surface 15 is formed at the rear edge of the upper surface 11, bent downwardly and rearwardly from the rear edge of the upper surface 11. The transition surface 15 is positioned between the upper surface 11 and the edge surface 13. The transition surface 15 may be bent from the rear edge or other positions of the upper surface 11 smoothly or non-smoothly/sharply.

Referring to FIGS. 1, 3, 4, and 5, the transition surface 15 comprises a front edge 151 joining the rear edge of the upper surface 11 and a rear edge 152 joining the upper side of the peripheral edge surface 13. The blocking surface 14 comprises a front edge 141 joining the lower surface 12 and a rear edge 142 joining the lower side of the peripheral edge surface 13.

Preferably, the blocking surface 14 and the transition surface 15 have similarly shaped front edges 141, 151 (i.e., corresponding points of the front edges 141, 151 having the same radius of curvature) and/or similarly shaped rear edges 142, 152 (i.e., corresponding points of the rear edges 142, 152 having the same radius of curvature). That is, the front edges 141, 151 share the same contour and are conformed to each other. The rear edges 142, 152 share the same contour and are conformed to each other.

Preferably, the blocking surface 14 is a concave curved surface and the transition surface 15 is a convex curved surface. The blocking surface 14 and transition surface 15 are configured with substantially identical curvature profiles, which improves aesthetic appearance of the artificial nail.

Preferably, a first sharp corner is formed at the intersection of the transition surface 15 and the peripheral edge surface 13. The first sharp corner has an included angle of less than 90°. A second sharp corner is formed at the intersection of the blocking surface 14 and the peripheral edge surface 13. The second sharp corner has an included angle of less than 90°. The first and second sharp corners are configured to obstruct the adhesive overflow therethrough. Preferably, the included angle of the first sharp corner is greater than that of the second sharp corner.

In operation, the user first applies an adequate amount of adhesive in the form of a viscous fluid to the adhesive-coating area on the lower surface 12 of the artificial nail body 1. The adhesive-coated lower surface 12 is then aligned and pressed firmly onto the natural nail. During the adhesive application and pressing process, any adhesive that tends to overflow outward is initially blocked by the blocking surface 14. For the adhesive to leak, it must overcome the barrier of the blocking surface 14. Even if a small amount of adhesive overflows the blocking surface 14, it must further pass through the edge surface 13 and the transition surface 15 before reaching the upper surface 11 of the artificial nail body 1, making it unlikely to affect the nail beautifying effect.

Thus, compared to the prior arts, the adhesive is unlikely to overflow from the lower surface, thus preventing any impact on the nail's aesthetic appearance.

In this embodiment, the artificial nail has a length in the front-rear direction and a width in the left-right direction. The length is greater than the width, so the adhesive-coating area is the rear half of the lower surface 12. However, in other embodiments, the artificial nail may adopt different styles, and the adhesive-coating area may vary accordingly. The blocking surface 14 can be adjusted in size based on the adhesive-coating area. For example, if the artificial nail is designed in a shorter style, the adhesive-coating area may extend over three-quarters of the lower surface starting from the rear thereof, and the blocking surface 14 can be extended and increased accordingly.

In this embodiment, the blocking surface 14 is not smoothly bent from the rear edge of the lower surface 12 but is instead bent sharply away from the upper surface 11 in order to enhance its adhesive-blocking effect. That is, the lower surface 12 and the blocking surface 14 transit non-smoothly (i.e., the lower surface 12 and the blocking surface 14 do not meet tangentially at the junction thereof), which facilitates to block the adhesive from flowing from the lower surface 12 to the blocking surface 14. Similarly, the transition surface 15 is not smoothly bent from the rear edge of the upper surface 11. That is, the upper surface 11 and the transition surface 15 transit non-smoothly, which facilitates to block the adhesive flowing from the transition surface 15 to the upper surface 11. Furthermore, the transition surface 15 extends downwardly and rearwardly from the rear edge of the upper surface 11. Thus, even if a minor amount of adhesive overflows onto the transition surface 15, it will not be visible from the front side, thus avoiding any impact on the nail beautifying effect.

The above description is merely for explaining the embodiments of the invention and is not intended to limit the patent protection scope of the invention. All inessential variations or substitutions made by those skilled in the art based on the invention should still fall within the protection scope of the invention.

What is claimed is:

1. An artificial nail, comprising an artificial nail body (1), the artificial nail body having an upper surface (11) and a lower surface (12) opposite to the upper surface (11), the upper surface (11) being convex;

wherein the artificial nail body (1) further comprises a peripheral edge surface (13) located between peripheral edges of the upper surface (11) and the lower surface (12);

the artificial nail body (1) further comprises a blocking surface (14) which is bent from the lower surface (12) in a direction away from the upper surface (11) and is located between the lower surface (12) and the peripheral edge surface (13);

the artificial nail body (1) further comprises a transition surface (15) extending downwardly from an edge of the upper surface (11) and is located between the peripheral edge surface (13) and the edge of the upper surface (11);

the transition surface (15) comprises a front edge (151) joining the upper surface (11) and a rear edge (152) joining a side of the peripheral edge surface (13);

the blocking surface (14) comprises a front edge (141) joining the lower surface (12) and a rear edge (142) joining an opposite side of the peripheral edge surface (13);

corresponding points of the front edges (151, 141) of the transition surface (15) and the blocking surface (14) have the same radius of curvature; and corresponding points of the rear edges (152, 142) of the transition surface (15) and the blocking surface (14) have the same radius of curvature.

2. The artificial nail according to claim 1, wherein the blocking surface (14) is arranged between a rear edge of the lower surface (12) and the peripheral edge surface (13).

3. The artificial nail according to claim 2, wherein there is a non-smooth transition between the lower surface (12) and the blocking surface (14).

4. The artificial nail according to claim 2, wherein a sharp corner is formed between the blocking surface (14) and the peripheral edge surface (13).

5. The artificial nail according to claim 1, wherein the transition surface (15) is located between the peripheral edge surface (13) and a rear edge of the upper surface (11).

6. The artificial nail according to claim 1, wherein the transition surface (15) is a convexly curved surface and the blocking surface (14) is a concavely curved surface.

7. The artificial nail according to claim 1, wherein a first sharp corner is formed between the transition surface (15) and the peripheral edge surface (13), and the first sharp corner has a first included angle of less than 90°;

a second sharp corner is formed between the blocking surface (14) and the peripheral edge surface (13) and the second sharp corner has a second included angle of less than 90°; and the first included angle is greater than the second included angle.

8. The artificial nail according to claim 4, wherein there is a non-smooth transition between the upper surface (11) and the transition surface (15).

* * * * *